US005164582A

United States Patent [19]

Boskma

[11] Patent Number: 5,164,582

[45] Date of Patent: Nov. 17, 1992

[54] METHOD FOR OPERATING AN IMAGE INTENSIFIER TUBE BY GENERATING HIGH FREQUENCY ALTERNATING ELECTRIC FIELD BETWEEN CATHODE AND CHANNEL PLATE THEREOF

[75] Inventor: Lieuwe W. Boskma, DB Roden, Netherlands

[73] Assignee: B.V. Optische Industrie "De Oude Delft", Delft, Netherlands

[21] Appl. No.: 634,156

[22] PCT Filed: Jun. 28, 1989

[86] PCT No.: PCT/EP89/00738

§ 371 Date: Dec. 11, 1990

§ 102(e) Date: Dec. 11, 1990

[87] PCT Pub. No.: WO90/00307

PCT Pub. Date: Jan. 11, 1990

[30] Foreign Application Priority Data

Jul. 1, 1988 [NL] Netherlands ..... 8801671

[51] Int. Cl.[5] ..... H01J 31/50

[52] U.S. Cl. ..... 250/214 VT; 313/532

[58] Field of Search ..... 250/213 VT, 207; 313/532-537, 103 CM, 105 CM

[56] References Cited

U.S. PATENT DOCUMENTS

| | | | |
|---|---|---|---|
| 3,564,260 | 2/1971 | Tanaka et al. | 250/213 R |
| 3,675,028 | 7/1972 | Grant | 250/213 VT |
| 3,870,917 | 3/1975 | Cuny | 313/105 |
| 4,134,009 | 1/1979 | Dippold | 250/213 VT |
| 4,691,099 | 9/1987 | Johnson | 313/534 |
| 4,882,481 | 11/1989 | Gilligan et al. | 313/537 |
| 4,891,581 | 1/1990 | Takiguchi | 250/213 VT |
| 4,926,039 | 5/1990 | Garfield et al. | 250/213 VT |
| 4,948,952 | 8/1990 | Guyot | 250/213 VT |

OTHER PUBLICATIONS

Soviet Inventions Illustrated, vol. 84, No. 2, Abstract No. 84-125809/20, SU 1035-680-A, Jun. 1964.

*Primary Examiner*—David C. Nelms
*Assistant Examiner*—Michael Messinger
*Attorney, Agent, or Firm*—Louis E. Marn

[57] ABSTRACT

An image intensifier tube is provided with a channel plate. The channel plate's channels are open both at the cathode side and at the anode side. A high frequency alternating electric field is generated in the space between the cathode and the channel plate. Thereby during a first period of the cycles of the alternating electric field the photoelectrons emitted by the photocathode traverse the space between the photocathode and the channel plate. During a second period of the cycles of the alternating electric field, in which second periods the polarity of the electric field is reversed with respect to the polarity during the first period, any ions that may have emerged from the channels into the space between the photocathode and the channel plate are drawn back to the channel plate.

7 Claims, 1 Drawing Sheet

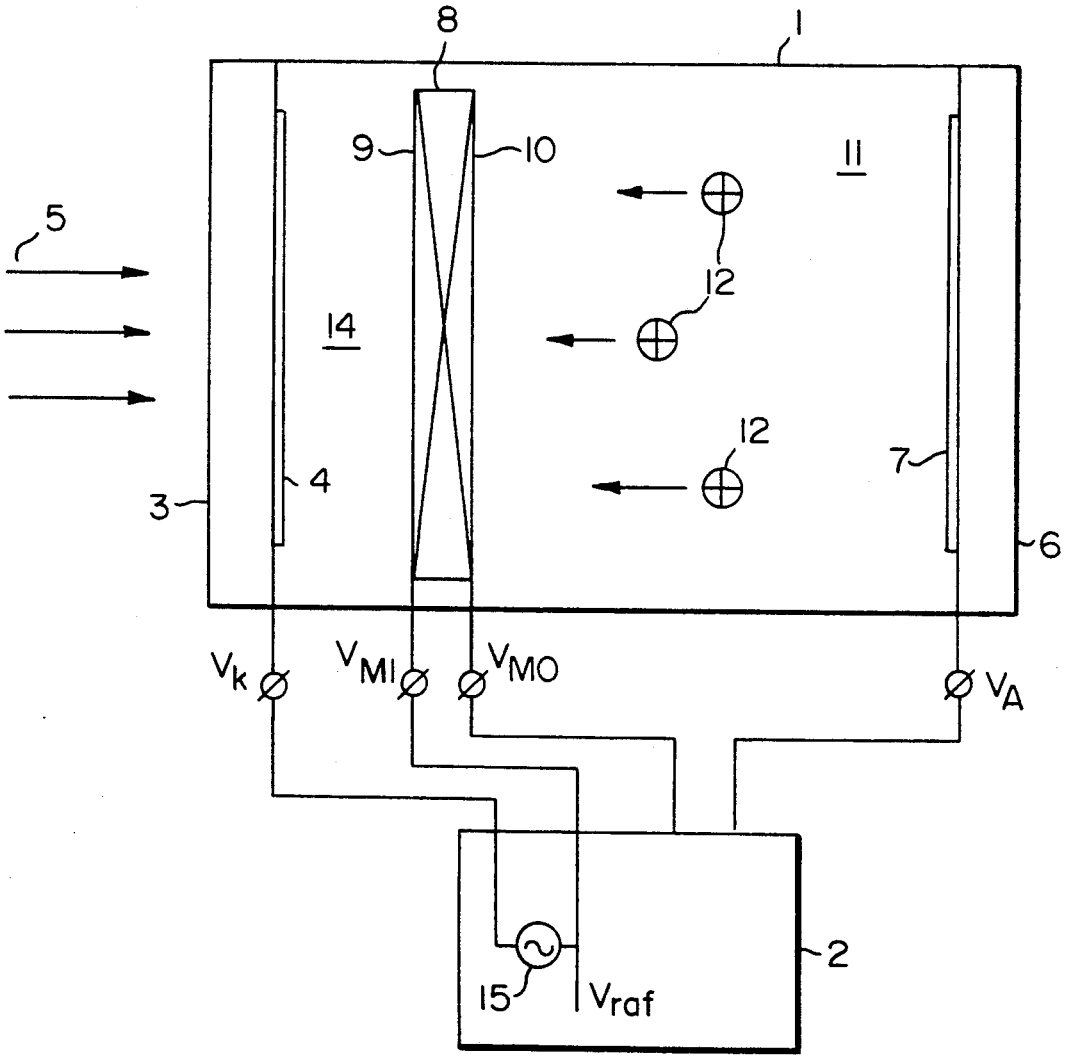
8
1
9
10
11
5
12
14
12
7
3
4
6
$V_k$
$V_{MI}$
$V_{MO}$
$V_A$
2
15
$V_{raf}$

METHOD FOR OPERATING AN IMAGE INTENSIFIER TUBE BY GENERATING HIGH FREQUENCY ALTERNATING ELECTRIC FIELD BETWEEN CATHODE AND CHANNEL PLATE THEREOF

The invention relates to a method for operating an image intensifier tube provided with a channel plate, which image intensifier tube has a cathode window which transmits the radiation to be intensified, a cathode fitted inside the tube which is capable of emitting electrons when exposed to radiation transmitted through the cathode window; an anode fitted opposite the cathode which is capable of forming a light image when exposed to incident electrons, an electric field being generated between the cathode and the anode such that electrons emitted by the cathode travel towards the anode, and a channel plate being placed between the cathode and the anode which exhibits secondary emission when exposed to incident electrons.

The invention furthermore relates to an image intensifier tube device provided with a channel plate.

An image intensifier tube having a channel plate is generally known, as is the manner in which such an image intensifier tube can be operated in practice. The channel plate is often denoted by the abbreviation MCP (Multi-Channel Plate).

A problem which has already been known for a very long time and which arises in the case of image intensifier tubes is that ions are produced in the tubes during operation, for example as a result of collisions between electrons and gas molecules which are still left behind in the tube and/or diffused out of materials present in the tube. Ions may also sometimes be produced by collisions between electrons and solid material in an image intensifier tube.

Such ions are positively charged and therefore travel towards the cathode under the influence of the electric field present between cathode and anode. The incidence of such ions on the cathode has an unfavourable effect on the operation of the cathode. It is in fact said that the cathode undergoes damage.

In an image intensifier tube provided with a channel plate, the undesirable ions are essentially produced in the channel plate. In order to prevent said ions reaching the cathode, according to a known technique the channel plate is equipped with a very thin membrane of a suitable material on the side facing the cathode. The membrane has a thickness such that electrons emitted by the cathode are able to penetrate through the membrane, but ions are held back by the membrane. In practice, the membrane has a thickness of the order of a few tens of ÅAngströms.

The fitting of an ion-repelling membrane on a channel plate is fairly complicated and consequently considerably increases the cost price. Furthermore, such a membrane is very vulnerable and has a negative effect on the signal/noise ratio of the image intensifier tube.

The object of the invention is to provide a method which renders the use of an ion-repelling membrane superfluous and also an image intensifier tube device in which a channel plate not having an ion-repelling membrane is used without there being a risk of the cathode being poisoned.

To this end, according to the invention, a method of the type described is characterized in that a high-frequency alternating electric field is generated in the space between the cathode and the channel plate.

An image intensifier tube device comprising at least one image intensifier tube provided with a channel plate situated between a cathode and an anode, and also a high-voltage supply device for providing the supply voltages needed for operating the image intensifier tube is characterized, according to the invention, in that the high-voltage supply device comprises a high-frequency alternating voltage source which is connected between a point carrying a reference potential and the cathode.

BRIEF DESCRIPTION OF THE DRAWING

The FIGURE is a schematic illustration of the present invention.

The invention is explained in more detail below with reference to the accompanying drawing.

The sole figure shows diagrammatically an image intensifier tube device comprising a housing 1 and a high-voltage supply device 2. The housing 1 has a cathode window 3 which, in this example, supports, on the inside, a cathode 4 which emits electrons when exposed to incident radiation 5 during operation.

The housing furthermore has an anode window 6 which supports, on the inside, an anode 7 which generates, when exposed to incident electrons, a light image which can be observed via the anode window. The anode window may, for example, be composed of an optical fibre plate.

Placed between the cathode and the anode there is furthermore a channel plate 8 which operates in a known manner as an electron multiplier.

The high-voltage supply 2 provides the supply voltages $V_K$, $V_A$, $V_{MI}$ and $V_{MO}$ required for a satisfactory operation of the image intensifier tube. The anode potential $V_A$ may be of the order of one or a few tens of kilovolts with respect to the cathode potential $V_K$. A potential difference $V_{MO}-V_{MI}$ exists across the channel plate 8 between the input side 9, facing the cathode, and the output side 10, facing the anode, $V_{MO}$ being appreciably less than $V_A$ while $V_{MI}$ is greater than $V_K$. In a practical situation, $V_K$ may be, for example, $-200$ V to $-900$ V with respect to $V_{MI}$. According to the known technique, fitted on the input side 9 of the channel plate there is a thin membrane which is capable of holding back positive ions 12 which are present or are generated in the space 11 between anode and channel plate or in the channel plate itself and which travel in the direction of the cathode under the influence of the electric field existing between anode and cathode. However, the ion-repelling membrane is thin enough to transmit the smaller electrons originating from the cathode.

According to the invention, such an ion-repelling membrane can be omitted because ions 12 are prevented from reaching the cathode in an electrical manner.

For this purpose, the cathode potential is varied at a high frequency in a manner such that the field direction periodically reverses in the space 14 between the cathode and the input side of the channel plate.

For this purpose, the high-voltage supply comprises a high-frequency alternating voltage source 15 which varies the cathode potential $V_K$ with respect to a suitable reference potential $V_{ref}$. The reference potential may advantageously be the input potential $V_{MI}$ of the channel plate, as shown. In a practical embodiment, the cathode potential may vary between approx. $-200$ V and approx. 1 kV with respect to $V_{MI}$.

With a suitable choice of the frequency of the source 15, no positive ions which reach the space 14 are incident on the cathode. Such ions either fall back on the channel plate or recombine with electrons in the space 14.

Since the electrons emitted by the cathode have an appreciably smaller mass than ions and are consequently much more intensely accelerated, the electrons are in fact able to reach the channel plate despite the periodically reversing field in the space 14. The period may be of the order of nanoseconds.

It is pointed out that, after the above, diverse modifications are obvious to the person skilled in the art. Thus, the invention may also be used in image intensifier tube devices having, for example, a matrix of photosensitive diodes at the anode side or image intensifier tube devices which comprises a number of image intensifier tubes connected in cascade. Furthermore, the cathode potential may be varied sinusoidally, but also, for example, in a pulsed manner. Such modifications are considered to fall within the scope of the invention.

I claim:

1. Method for operating an image intensifier tube having an anode a channel plate, a cathode window for radiation to be intensified and a cathode capable of emitting electrons when exposed to radiation transmitted through said cathode and capable of forming a light image when exposed to incident electrons wherein generation of an electric field between said cathode and anode electrons emitting by said cathode travel towards said anode and said channel plate placed between said cathode and said anode exhibits secondary emission when exposed to incident electrons, characterized by generating a high-frequency alternating electric field in a space between said cathode and said channel plate.

2. Method according to claim 1, characterized by applying a reference potential to a side of said channel plate facing said cathode and by varying periodically a potential with respect to said reference potential applied to said cathode.

3. Method according to claim 2, characterized by varying cathode potential with respect to the reference potential between a negative value in the order of one or a few hundred volts and a positive value in the order of one or a few kilovolts.

4. Method according to claim 2 or 3, characterized by varying period of said potential in nanoseconds.

5. Image intensifier tube device comprising at least one image intensifier tube provided with a channel plate situated between a cathode and an anode and a high-voltage supply device for providing supply voltages for operating said image intensifier tube, said high-voltage supply devices including a source of high-frequency alternating voltage connected between a point carrying a reference potential and said cathode.

6. Image intensifier tube device according to claim 5 wherein said reference potential is potential of a side of said channel plate facing said cathode.

7. The image intensifier tube apparatus according to claim 5 or 6 wherein output terminals for supplying operating voltages to said cathode and channel plate are connected to a source of high-frequency alternating voltage source capable of generating a high-frequency alternating voltage therebetween.

* * * * *